United States Patent [19]

Farnham

[11] 4,337,014

[45] Jun. 29, 1982

[54] METHOD AND APPARATUS FOR ERECTING A PORTABLE SILO AND ELEVATOR

[75] Inventor: Robert E. Farnham, Naperville, Ill.

[73] Assignee: Barber-Greene Company, Aurora, Ill.

[21] Appl. No.: 211,367

[22] Filed: Nov. 28, 1980

[51] Int. Cl.[3] ..... E04H 7/00

[52] U.S. Cl. ..... 414/332; 414/786

[58] Field of Search ..... 414/332, 786, 787, 918; 52/64, 143, 194, 197

[56] References Cited

U.S. PATENT DOCUMENTS

| | | | |
|---|---|---|---|
| 2,112,326 | 3/1938 | Berner | 94/41 |
| 2,805,052 | 9/1957 | Preeman | 259/159 |
| 2,945,683 | 7/1960 | Martinson | 259/159 |
| 3,112,099 | 11/1963 | Heise | 259/145 |
| 3,116,051 | 12/1963 | Preeman | 259/153 |
| 3,142,390 | 7/1964 | Preeman | 214/17 |
| 3,458,177 | 7/1969 | Farnham | 259/153 |
| 4,187,047 | 2/1980 | Squifflet, Sr. | 414/332 |

OTHER PUBLICATIONS

Promotional Literature Concerning Model G50 Bituminous Mixing Plant Manufactured by Cedarapids.

Literature Illustrating Erection of Model S-E Mobile Asphalt Plant made by Standard Steel.

*Primary Examiner*—Robert G. Sheridan

*Attorney, Agent, or Firm*—McDougall, Hersh & Scott

[57] ABSTRACT

The bottom end of a portable silo and elevator are each hingedly mounted to a base. The lower end of a mast is pivotally disposed in juxtaposition with said base and the upper end of the mast carries block and tackle means coupled to the silo and elevator for hingedly raising the same about the base.

11 Claims, 6 Drawing Figures

TO TRUCK X

TO TRUCK X
TO TRUCK Y
TRUCK Z

METHOD AND APPARATUS FOR ERECTING A PORTABLE SILO AND ELEVATOR

BACKGROUND OF THE INVENTION

The present invention relates generally to a portable plant and in particular to an asphalt making plant including a portable silo and elevator capable of being self-erected at a remote site and a method for erecting same. As used herein, "self-erecting" means being able to be erected without the assistance of cranes, forklifts, or jacks.

In cases where a truck must transport asphalt from a fixed plant location over a considerable distance, it becomes economically attractive to provide a portable plant for producing asphalt at or near the final destination of the asphalt. Although portable plants of various designs have been previously employed, large capacity portable silos, that is 100 tons or more, have typically used a large crane for erection or have utilized complicated lifting mechanisms.

PRIOR ART

U.S. Pat. No. 2,112,326 discloses a portable asphalt mixing plant wherein two trucks transport a silo and elevator section, respectively, to an erection site. The silo is initially jacked to a first position and an A-frame, which forms part of the silo, is erected. The elevator is jacked from a horizontal position to an initial inclined position and raised to a final vertical position by a block and tackle attached to the top of the A-frame. A horizontal supply bin, which comprises part of the silo, is then pivoted to an upright position by a block and tackle attached to the top of the elevator to complete the plant erection.

Another portable plant is disclosed in U.S. Pat. No. 3,142,390 wherein a silo is initially erected by means of an integral lifting mechanism consisting of chains and sprockets. A horizontal elevator is pivotally connected to a base which is placed adjacent two of the legs which support the silo. A block and tackle attached to an upper portion of the previously erected silo are utilized to pivot the elevator about the base to a vertical working position.

The following U.S. Patents disclose various other designs for mobile or portable mixing plants: No. 2,805,052, entitled Mobile Asphalt Plant; No. 2,945,683, entitled Mobile Asphalt Plant; No. 3,112,099, entitled Sieving and Mixing Machine for Processing and Loading Building Materials; No. 3,116,051, entitled Mobile Mixing Plant; No. 3,345,177, entitled Portable Batch Tower; and No. 4,187,047, entitled System and Apparatus for Erecting a Portable Silo and Elevator Structure.

SUMMARY OF THE INVENTION

The present invention provides an improved self-erecting plant including a mobile silo and elevator, each having a bottom portion which is hingedly coupled to a portable base. A mast pivotally carried by the elevator in the preferred embodiment is erected vertically above the portable base. Block and tackle means couple the upper end of the mast to the silo and elevator enabling the same to be pivoted about the base from horizontal travel positions to vertical working positions. The present invention also includes a method for self-erecting such a plant.

An object of the present invention is to provide a self-erecting plant, including a mast and block and tackle means permanently reeved to the top of the mast, which can be easily and safely erected.

A further object of the present invention is to provide a method by which such a self-erecting plant can be erected.

DESCRIPTION OF THE PREFERRED EMBODIMENT

The present invention has application to conventional silos and elevators of various designs and, therefore, only those features of the particular silo and elevator illustrated herein which assist in understanding the present invention will be described.

Figures 1, 2, 3:
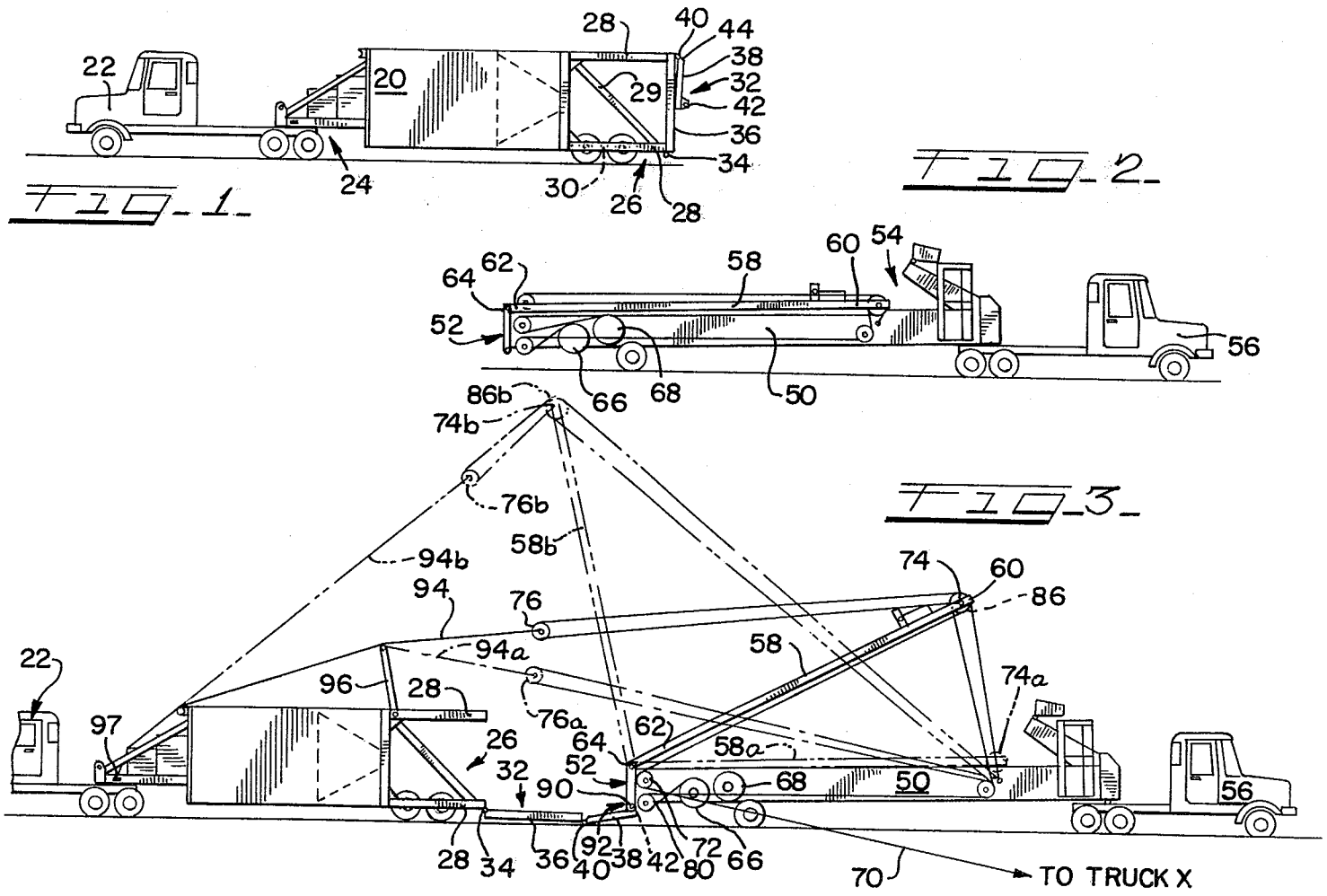
FIG. 1 is a side elevational view illustrating a mobile silo in its travel position.
FIG. 2 is a side elevational view showing a mobile elevator in its travel position.
FIG. 3 is a side elevational view showing the elevator and silo connected to a base with a mast shown in three stages of erection.
Figure 4:
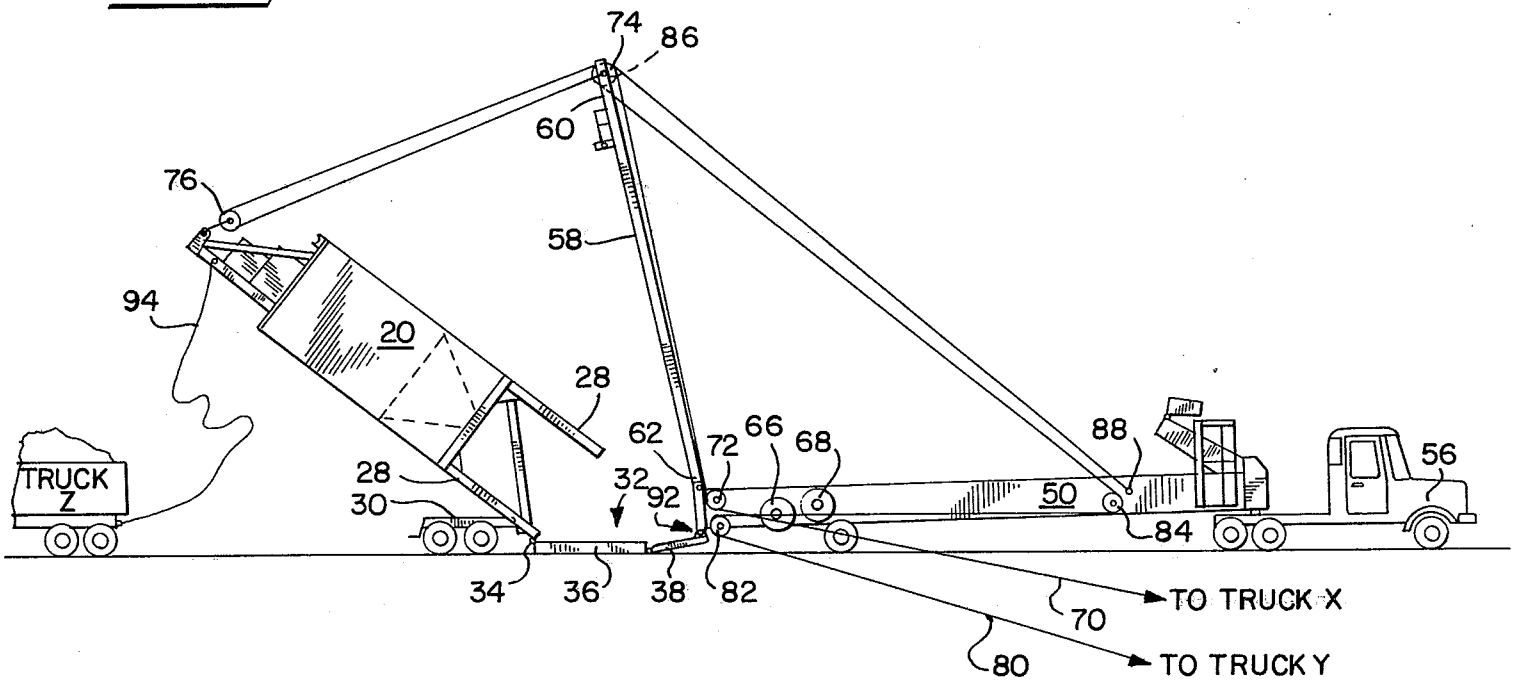
FIG. 4 is a side elevational view illustrating the silo in an intermediate position.

Now referring in particular to FIG. 1, a mobile silo 20 is shown being pulled by truck 22. The silo includes a top portion 24 which is coupled to truck 22 and a bottom portion 26 having four supporting legs 28 and a pair of temporary braces 29. A carriage assembly 30 (as best illustrated in FIG. 4) supports the bottom portion 26 of the silo and provides two pairs of axially mounted wheels that support the silo during transportation to an erection site.

A base 32 includes a primary section 36 which is mounted to a secondary section 38 by means of hinges 40. The secondary section 38 has a pair of mounting brackets 42 mounted adjacent its distal end and has a beveled end 44 adjacent hinges 40. The base is supported in its folded travel position by hinges 34 which are mounted to the bottom two legs 28 of the silo and temporarily supported by the upper two legs 28 during transportation by any conventional means, such as being bolted thereto. The base is preferably constructed of steel members. Further details concerning the function of base 32 is provided below.

Referring to FIG. 2, a mobile elevator 50 having a bottom portion 52 and a top portion 54 is illustrated being towed by truck 56 in its horizontal travel position. The elevator carries a longitudinal mast 58 having an upper end 60 and a lower end 62 which is mounted to bottom portion 52 of the elevator by hinge means 64. The mast is preferably constructed from two parallel spaced apart longitudinal steel members and includes a plurality of cross-braces connected between these members. The upper end 60 of mast 58 has permanently reeved thereto a first and second block and tackle means which include respectively a first and second cable which are stored when not in use on takeup spools 66 and 68. The first block and tackle means (see FIG. 4) consists of a cable 70 that traces a path around sheaves 72, 74, and 76 and terminates at an anchor point on the upper end 60 of mast 58. The second block and tackle means consists of a cable 80 which traces a path about sheaves 82, 84, and 86 (not shown) and terminates at anchor point 88 at the top portion 54 of elevator 50. The surplus of cables 70 and 80 is wound around takeup spools 68 and 66, respectively, when the mast 58 is in its horizontal travel position as shown in FIG. 2.

Referring to FIG. 3, it will be apparent that the bottom portion 26 of the silo and the bottom portion 52 of the elevator have been aligned in adjacent opposing relationship with respect to each other. The means used to temporarily secure base 32 to upper legs 28 has been released allowing the base to pivot about hinges 34 to assume a substantially horizontal position resting on the ground about hinges 40. The secondary section 38 of the base has been raised so that holes in base brackets 42 align with mating holes in bracket 90 of the bottom portion 52 of the elevator which permits bolts to be inserted through these holes to define hinges 92. Thus, the base is hingedly connected to the bottom of the silo and elevator.

FIG. 3 illustrates mast 58 (shown in solid lines) in an intermediate position. Broken lines are used to illustrate the mast, cables and sheaves in a beginning position and in a final erected position; corresponding numerals with the suffix "a" and "b" are used to designate like elements at the beginning and final positions, respectively. One end of cable **94*a* is attached to sheave 76*a* and the other end is anchored to anchor point 97 on the silo. Cable 94*a* is supported intermediate of its ends by temporary supporting member 96 which is fastened to the upper legs 28 of the silo and serves to support cable 94*a* at a slightly larger angle with respect to the horizontal so as to reduce the forces present in cable 94*a* as the mast 58*a* begins to pivot away from the elevator. Since the mast is relatively light, excessive cable tension is not encountered. The excess length of cable 70 is removed from takeup spool 68 and cable 70 secured to truck X (not shown). Takeup spool 66 is free to rotate and thereby let out additional lengths of cable 80 as is needed. The silo and elevator remain connected to truck 22 and 56, respectively, thereby anchoring the silo and elevator in the positions as shown in FIG. 3**.

As truck X slowly moves away from sheave 72, the force exerted by cable 70 on the upper portion of the mast forces the mast to begin pivoting upwardly about hinge 64. Cable 80, which is coupled to the upper end of the mast, provides no resistance to the lifting forces produced by cable 70 since additional length of cable 80 is unwound from takeup spool 66 as the mast rises. As truck X continues to move away from sheave 72, the mast will continue to pivot upwardly through the intermediate position indicated by solid lines and will approach an angle of 90 degrees with respect to the ground. Prior to approaching the 90 degree angle, the remaining cable 80 is unwound from takeup spool 66 and anchored to another truck Y (not shown). The purpose of anchoring cable 80 to truck Y at this stage is so that a means of applying a clockwise force to the mast will be available to prevent the mast from falling counterclockwise about hinge 64 when the center of gravity of the mast is shifted to the left of hinge 64.

Mast **58*b* is supported in its final working position by cable 80 which is secured to truck Y. Slack in cable 70 is created by moving truck X closer to sheave 72. This permits sheave 76*b* which has cable 70 reeved therethrough to be pulled by means of cable 94*b* to the ground. Cable 94*b* is disconnected from sheave 76*b* which is then connected to the top portion of the silo by a short length of cable. Thus, the first block and tackle means is coupled between the top of the silo and the upper end of the mast. Similarly, the upper end of the elevator is coupled by the second block and tackle means to the upper end of the mast. Therefore, cables 70 and 80** which are connected respectively to truck X and truck Y, provide a means by which a lifting force can be applied to the upper portions of the silo and elevator.

Prior to the erection of the silo, truck X is moved away from sheave 72 until cable 70 becomes taut and the end of cable 94 which had been connected to sheave **76*b* is secured to truck Z (see FIG. 4). The top end of the silo is uncoupled from truck 22, thus freeing the silo to pivot about hinges 34**.

Now referring in particular to FIG. 4, the silo is shown in an intermediate raised position. It will be noted that while the silo is being raised, the top portion of the elevator remains secured to truck 56 to anchor the elevator in its horizontal position. Also, truck Y serves as a stationary anchor for cable 80, thus guying the upper end 60 of mast 58. A lifting force is applied to the top end of the silo by means of cable 70 as truck X slowly moves away from sheave 72. This lifting force is transmitted through the first block and tackle means and causes the silo to pivot upwardly about hinges 34. In the intermediate raised position of the silo as illustrated in FIG. 4, it will be noted that the lower legs 28 have been lifted away from carriage assembly 30. The carriage assembly is secured to the legs 28 by means of bolts during transportation and, of course, these bolts are removed prior to the beginning of the raising of the silo. Any movement of base 32 as the silo is being raised is inhibited since the base is connected by means of hinges 92 to the bottom portion of the elevator which is stationary. Truck X continues to provide a lifting force through cable 70 to the silo until the silo reaches a position wherein its center of gravity is close to being disposed above hinge 34. At this time truck Z moves to the left and away from the silo bringing cable 94 taut. The movement of truck X and Truck Z is coordinated so that as the position of the silo reaches a point where its center of gravity is to the right of hinge 34, cable 94 serves to restrain the silo. Truck Z slowly moves closer to the base thereby gently allowing legs 28 to come to rest upon the base. Preferably, the legs 28 of silo 20 are bolted to the primary section 36 of the base.

Figures 5, 6:
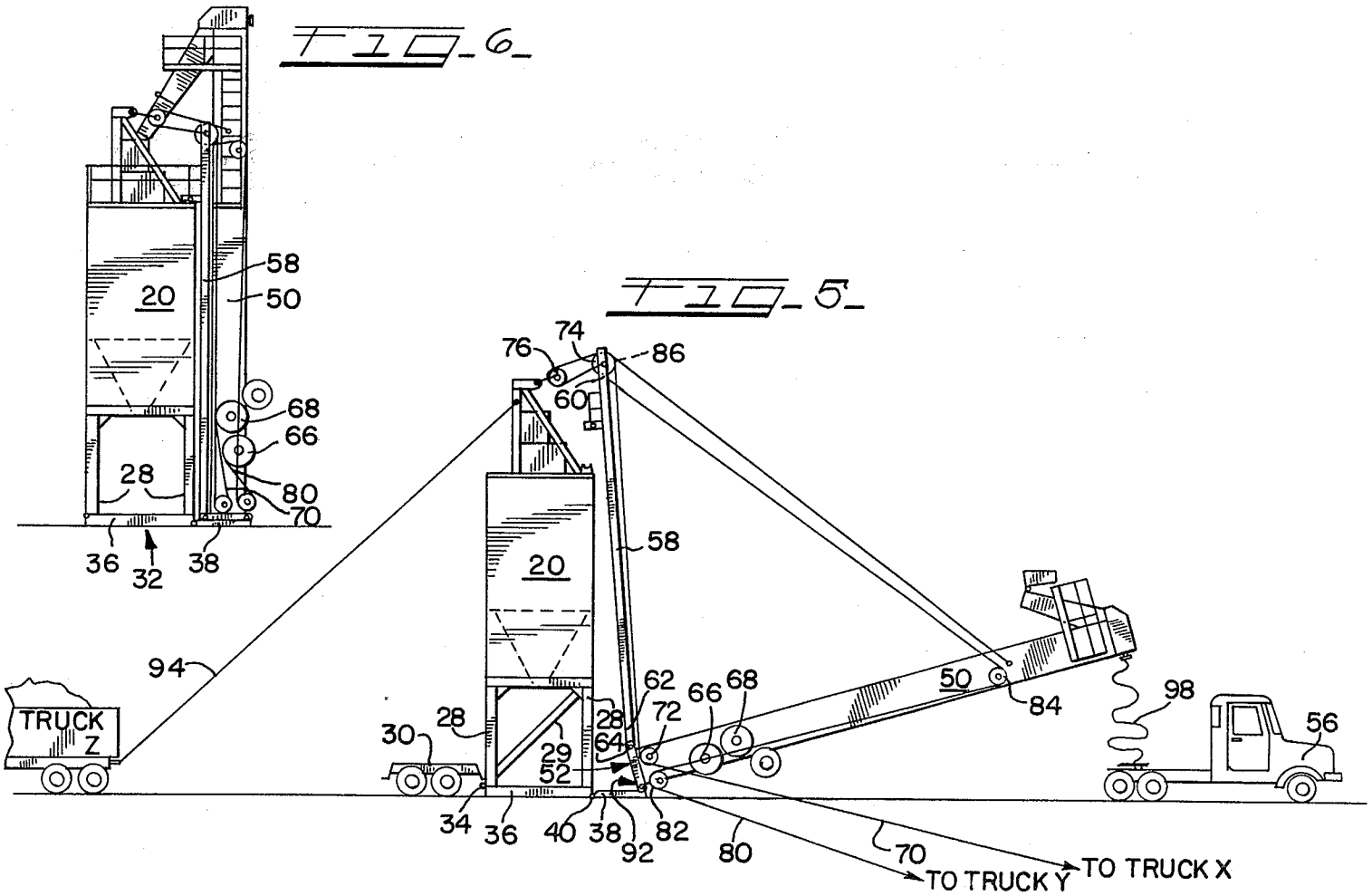
FIG. 5 is a side elevational view illustrating the silo in a final vertical position and the elevator in an intermediate position.
FIG. 6 is a side elevational view illustrating the silo, elevator and mast in final vertical positions.

Now referring to FIG. 5, the elevator 50 is illustrated being raised. Prior to raising the elevator, the silo 20 has been raised to its final working position and is anchored by cable 94. Cable 70 which is held taut by stationary truck X anchors the mast against clockwise movement. The top portion of the elevator is uncoupled from truck 56 and a lifting force is provided by the second block and tackle means to the elevator. More specifically, a lifting force is transmitted to the elevator by cable 80 as truck Y moves away from sheave 82.

The elevator 50 pivots upwardly about hinge 92 which connects the bottom of the elevator 52 to the secondary portion of the base 38. It will also be apparent that as the bottom portion 52 of the elevator pivots counterclockwise about the base, the lower end 62 of the mast pivots with respect to the bottom portion 52 about hinges 64. A cable 98 which is connected to the top portion of the elevator and to truck 56 serves the same function as cable 94 did with respect to the silo, that is, cable 98 remains slack until the elevator reaches a position where its center of gravity becomes disposed over hinges 92. At this time, cable 98 is brought taut by movement of truck 56 so as to restrain the natural tendency of the elevator to pivot counterclockwise under the influence of gravity. As the final vertical working position of elevator 50 is approached, trucks X, Y and 56 move in concert so that the mast 58 gently assumes its final vertical position contiguously disposed between silo 20 and elevator 50 as shown in FIG. 6.

An erected plant according to the present invention is illustrated in FIG. 6 and includes silo 20, integral mast 58, and elevator 50 which are supported by base 32. The excess of cable 70 and 80 are wound respectively on takeup spools 68 and 66. By comparing FIG. 6 with FIG. 5, it will be apparent that temporary cross-brace members 29 have been removed as has carriage assembly 30. The two cross-brace members 29 are bolted between left-hand legs 28 to provide additional support therebetween. The legs 28 have sufficient length so as to permit a truck to drive between the left-hand and right-hand legs 28 to receive material directly from the silo. The primary section 32 of the base preferably includes two parallel spaced apart members which will support the wheels of the trucks as they are driven over the base to receive material from the silo. The silo, mast and elevator are secured together using conventional means such as bolts when final assembly is completed.

The present invention as described above and illustrated in the accompanying drawings provides several advantages. First, no lifting equipment such as cranes, forklifts or jacks are required at any stage in the erection of the plant. Thus, the erection of this plant is not dependent upon external lifting equipment which must be provided at an erection site. Although prior designs have used a block and tackle in erecting a portable plant, jacks or other equivalent means were needed to initially raise the silo or elevator to a position somewhat above horizontal before the block and tackle was utilized to finish raising the units. Such designs could not employ a block and tackle initially because extremely small cable angles with respect to horizontal were encountered while attempting to erect the first member from a horizontal to a vertical position. Small cable angles create excessive cable forces in attempting to provide a vertical lifting force with a cable that was substantially horizontal. In the present invention, cable tensions are well within safety limits since the cable forms a substantial angle with respect to the horizontal during the initial lifting of the silo. Also in the present invention, the block and tackle cables remain reeved to the various sheaves both during transportation and final assembly thereby eliminating on the site assembly or disassembly. The mast of the present invention is a permanent and integral part of the plant thereby simplifying the erection of the plant.

By utilizing the concepts of the present invention, silos and elevators are no longer limited by the lifting equipment available at a site but are limited in size only by highway restrictions. The preferred embodiment of the present invention illustrates a self-erecting silo and elevator having a hundred ton capacity wherein the height of the elevator exceeds 50 feet. With the present invention, components associated with silos and elevators such as chutes and walkways can remain mounted thereto both during transportation and erection.

It is to be understood that the preferred embodiment of the present invention disclosed herein and the method disclosed for erecting a portable plant are illustrative of the concepts of the present invention, the scope of the present invention being defined by the claims appended hereto.

What is claimed is:

1. An improved self-erecting plant including an elongate silo and elevator, each having means for being transported in a generally horizontal position to an erection site and each being functional in a generally vertical position wherein each consists of a top and bottom portion, the improvement comprising:

(a) a base hingedly connected to the bottom portion of said silo and the bottom portion of said elevator;

(b) a vertically disposed mast having an upper and a lower end, said lower end being mounted in juxtaposition with said base;

(c) a first block and tackle means, coupled between the top portion of said silo and the upper end of said mast, for pivotally raising said silo about said base from a horizontal to vertical position;

(d) a second block and tackle means, coupled between the top portion of said elevator and the upper end of said mast, for pivotally raising said elevator about said base from a horizontal to a vertical position, the upper end of said mast providing said first and second block and tackle means with an advantageous elevated position from which to apply a lifting force to said horizontally disposed elevator and silo.

2. The apparatus according to claim 1 wherein said mast is substantially contiguously disposed between said silo and elevator when the latter are in vertical positions.

3. The apparatus according to claim 1 wherein said base is comprised of a primary section and a secondary section, said primary and secondary sections being hingedly connected to each other whereby said base can be folded for ease of transportation.

4. The apparatus according to claim 1 wherein said base is substantially horizontally disposed and supports said silo and elevator when the latter are in vertical positions.

5. The apparatus according to claim 1 wherein said mast comprises first and second parallel spaced apart members, and cross-bracing members connected therebetween.

6. The apparatus according to claim 1 wherein said first and second block and tackle means are reeved to the upper end of said mast.

7. The apparatus according to claim 6 wherein said first and second block and tackle means are permanently reeved to the upper end of said mast.

8. The apparatus according to claim 1 wherein the lower end of said mast is hingedly mounted to the bottom portion of said elevator.

9. An improved self-erecting plant including an elongate silo and elevator, each having means for being transported in a generally horizontal position to an erection site and each being functional in a generally vertical position wherein each consists of a top and bottom portion, the improvement comprising:

(a) a base hingedly connected to the bottom portion of said silo and the bottom portion of said elevator;

(b) a longitudinal mast having an upper and a lower end, said lower end hingedly mounted to the bottom portion of said elevator;

(c) a first block and tackle means, coupled between the top portion of said silo and the upper end of said mast, for pivotally raising said silo about said base from a horizontal to vertical position;

(d) a second block and tackle means, coupled between the top portion of said elevator and the upper end of said mast, for pivotally raising said elevator about said base from a horizontal to a vertical position, said first and second block and tackle means permanently reeved to the upper end of said mast, whereby said mast provides said first and second block and tackle means with an advantageous elevated position from which to apply a lifting force to said horizontally disposed elevator and silo.

10. A method for erecting a self-erecting plant which includes an elongate silo and elevator, each having a means for being transported in a generally horizontal position to an erection site and each consisting of a top and bottom portion, said plant further including a base, a longitudinal mast having an upper end and a lower end hingedly mounted adjacent said base, a first and second block and tackle means each coupled to the upper end of said mast and coupled respectively to the top portion of said silo and the top portion of said elevator, said method comprising the steps of:

(a) aligning said horizontally disposed elevator and silo in opposing bottom-to-bottom relationship, (b) connecting the bottom portion of said silo and the bottom portion of said elevator to said base for pivotal movement about the latter, (c) hingedly raising said mast above said base to a substantially vertical position, (d) applying a lifting force to the top portion of said horizontally disposed silo by said first block and tackle means so as to cause said silo to pivot about said base to assume a vertical position, (e) applying a lifting force to the top portion of said elevator by said second block and tackle means causing said elevator to pivot about said base to assume a vertical position, thereby erecting said plant.

11. The method according to claim 10 further comprising the step, which precedes step (b), of lowering said base which is carried by silo during transportation to the erection site to the ground.

* * * * *